US012799830B2

(12) United States Patent
Lan et al.

(10) Patent No.: US 12,799,830 B2
(45) Date of Patent: Nov. 17, 2026

(54) DEVICE AND ITS APPLICATION METHOD FOR IN-SITU CUTTING SOIL IN BOREHOLE

(71) Applicant: CHANG'AN UNIVERSITY, Xi'an (CN)

(72) Inventors: Hengxing Lan, Xi'an (CN); Changgen Yan, Xi'an (CN); Mervyn Lan, Edmonton (CA); Mingyu Yang, Xi'an (CN); Han Bao, Xi'an (CN); Wenbin Lei, Xi'an (CN); Zhonghong Dong, Xi'an (CN)

(73) Assignee: CHANG'AN UNIVERSITY, Xi'an (CN)

( * ) Notice: Subject to any disclaimer, the term of this patent is extended or adjusted under 35 U.S.C. 154(b) by 0 days.

(21) Appl. No.: 18/703,730

(22) PCT Filed: Feb. 22, 2024

(86) PCT No.: PCT/CN2024/078062
§ 371 (c)(1),
(2) Date: Oct. 23, 2025

(87) PCT Pub. No.: WO2024/179355
PCT Pub. Date: Sep. 6, 2024

(65) Prior Publication Data

US 2026/0125952 A1 May 7, 2026

(30) Foreign Application Priority Data

Feb. 27, 2023 (CN) ..... 202310170629.X

(51) Int. Cl.
*E21B 10/32* (2006.01)
*E02D 1/02* (2006.01)

(52) U.S. Cl.
CPC ..... *E21B 10/32* (2013.01); *E02D 1/022* (2013.01)

(58) Field of Classification Search
CPC ..... E21B 10/32; E02D 1/022; G01N 3/24; G01N 3/02
See application file for complete search history.

(56) References Cited

U.S. PATENT DOCUMENTS

2025/0092899 A1* 3/2025 Kao ..... B25B 31/00
2026/0125952 A1* 5/2026 Lan ..... E21B 10/32

FOREIGN PATENT DOCUMENTS

CN 210598950 U * 5/2020
CN 113186893 A * 7/2021 ..... E02D 1/022

(Continued)

*Primary Examiner* — Daniel P Stephenson
(74) *Attorney, Agent, or Firm* — Nitin Kaushik

(57) ABSTRACT

The invention offers a device and method for in-situ cutting soil in boreholes. The device comprises a base with an accommodation cavity, a cutting mechanism attached to the base, featuring a driven driving part within the cavity and a cutting part at its opposite end. A telescopic drive mechanism atop the base connects to the cutting mechanism, facilitating its extension relative to the base along its length. A rotating drive mechanism at the base's bottom includes an active driving part within the cavity, rotating the cutting mechanism around its length axis. This enables the cutting part to slice soil along a plane perpendicular to its length extension. The device enables borehole tests to achieve a flat test surface, enhancing accuracy and effectiveness.

11 Claims, 11 Drawing Sheets

(56) References Cited

FOREIGN PATENT DOCUMENTS

| | | | | | |
|---|---|---|---|---|---|
| CN | 113776925 | A | * | 12/2021 | ..... G01N 3/58 |
| CN | 114184485 | A | * | 3/2022 | ..... G01N 3/062 |
| CN | 114704205 | B | * | 12/2022 | ..... E21B 7/06 |
| CN | 110067524 | B | * | 12/2024 | ..... E21B 37/02 |
| CN | 116296892 | B | * | 3/2026 | ..... E02D 1/022 |

* cited by examiner

DEVICE AND ITS APPLICATION METHOD FOR IN-SITU CUTTING SOIL IN BOREHOLE

TECHNICAL FIELD

The present invention relates to the field of geotechnical engineering technology, in particular to a device and its application method for in-situ cutting soil in borehole.

BACKGROUND ART

The shear strength parameters of soil are the key index of engineering foundation design and the basis of building foundation stability analysis, which is related to the economy and safety of the whole project. At present, the shear strength parameters of soil are mainly obtained by indoor shear test or in-situ (or on-site) borehole shear test. The limitation of sample size in laboratory test leads to poor representativeness; the in-situ shear test is to apply an external load to the soil at the operating point, in the natural structure and stress environment of soil, the mechanical parameters of soil are obtained directly, which overcomes the shortcomings of soil disturbance and size effect in laboratory test, and the measured soil strength parameters are more accurate.

Wherein, there are many kinds of soil, such as loess is a kind of collapsible soil, and the particle arrangement structure is quite different in the vertical direction and the horizontal direction. When rain falls, the loess slope will be collapsible by water, the structural strength is greatly reduced, resulting in a large area of landslide. Therefore, it is urgent to study the anisotropic permeability parameters of loess.

In the process of realizing the invention, the inventors discover that there are at least the following problems in the prior art:

The existing soil in-situ test devices, such as pressuremeter, plate load tester and flat dilatometer, have the following disadvantages:

The pressuremeter: the pressuremeter includes three types: pre-drilling type, self-drilling type and pressing type, wherein the pressing type has obvious squeezing effect on the soil and is rarely used.

The pre-drilling pressuremeter is represented by the French Mena pressuremeter, which needs to be drilled in advance, after considerable development, the product has realized the automation function(such as Geospad2 Mena pressuremeter, GeoPAC automatic control Mena pressuremeter, etc.), which includes automatic data acquisition, automatic execution of the test according to the set steps, independent elastic film constraint force and comprehensive deformation correction technology.

The self-drilling pressuremeter is a one-time completion of drilling, pressuremeter equipment, positioning and testing, which has the characteristics of small disturbance to the soil of the borehole wall.

Represented by the French PAF and British Camkometer pressuremeter in the 1970 s, after several generations of product updates, it has been digitized and automated, with flexible operation and high accuracy, and the obtained parameters do not require empirical correction.

In terms of multifunctional pressuremeter: the third generation of French bridge type pressuremeter (PAF-76 type) probe can be replaced by other functional devices (such as shear instrument, permeameter and friction instrument, etc.), to achieve the purpose of multi-purpose borehole. In the late 1990 s, Xu Guangli and Qiantian Liangdao developed an in-situ shear combined pressuremeter, which can simultaneously measure mechanical parameters such as shear strength and deformation modulus, and then improved into a self-drilling in-situ shear pressuremeter.

Flate dilatometer tester: one of the biggest characteristics of the flat dilatometer test is that it can provide the stress history information of the soil, Based on this, the influence of stress history can be well taken into account in the estimation of compression modulus of over-consolidated or under-consolidated soil. At present, the mainstream flat dilatometer equipment on the market includes two types: standard flat dilatometer tester (DMT) and seismic flat dilatometer tester (SDMT). The flat dilatometer test has the advantages of simple operation, continuous test, small disturbance, low cost and good repeatability, and it can be directly pressed into the soil by static penetration equipment or drilling rig. However, due to the small central membrane area of the flat shovel probe, when the soil particle composition contains a large number of stones, it is very easy to be unevenly stressed or difficult to penetrate, which is easy to cause large discreteness of test data or damage to the diaphragm. Therefore, the flat dilatometer test is not suitable for gravel soil or soil layer containing rubble, and the direction of soil force is inconsistent with the direction of actual soil load. The test results are based on statistical analysis and empirical formulas, and the results have regional attributes.

Plate load tester: the plate load test is one of the earliest and most widely used soil test methods, it is an in-situ test to observe the pressure and deformation of natural foundation soil under various loads by applying loads on a certain size of rigid bearing plate. Changchun Institute of Technology has developed a deep plate load test device SP-1, with a depth of 100 m, which can eliminate the influence of depth measurement on displacement, force transmission column and borehole wall friction on load measurement, and realize automatic display, storage and printing functions. Some scholars have developed a simple plate load test device that is not limited by the site, the device uses the soil around the test point as the counterforce of the counterweight to realize the test in the area with inconvenient transportation. The load test of developed countries in Europe and the United States has realized the wireless data transmission technology, which has the characteristics of absolutely controllable test and efficient operation, the operator does not need to be in a high-risk environment for close operation. South Korea Ocean University has developed a small spiral plate load tester, which reduces the size of the traditional spiral plate from 160 mm to 75 mm, and can directly carry out the load test in the borehole. At the same time, the hydraulic pressure is used to replace the cylinder device, which reduces the weight of the test instrument. However, in general, the plate load test has the disadvantages of relatively cumbersome operation, heavy instrument and high test cost.

In general, the existing in-situ testing devices in soil pores have the following shortcomings: the test surface tested in borehole is a curved surface rather than a plane, which makes the collected data have a greater difference; or the existing device is limited to cutting soil in a single direction; or the previous cutting device size is larger, the soil disturbance is larger, it is difficult to retain the integrity of the soil; and or the previous cutting device is difficult to operate.

Therefore, a device and its application method for in-situ cutting soil in borehole are needed to solve the above technical problems at least in part.

SUMMARY

The embodiment of the present invention provides a device and its application method for in-situ cutting soil in borehole, which can realize that the test surface of the borehole test is a plane.

In the first aspect, the present invention provides the device for in-situ cutting soil in borehole, which includes:

a base in which an accommodation cavity is arranged;

a cutting mechanism, wherein the cutting mechanism is set to the base, the cutting mechanism includes a driven driving part arranged in the accommodation cavity and a cutting part located at the opposite end of the driven driving part;

a telescopic drive mechanism, wherein the telescopic driving mechanism is arranged to the top of the base and connected to the cutting mechanism, which can drive the cutting mechanism to stretch relative to the base along its length extension direction; and a rotating drive mechanism, the rotating drive mechanism is set to the bottom of the base, the rotating driving mechanism includes an active driving part arranged in the accommodation cavity, the rotating drive mechanism is driven by the active driving part and the driven driving part to drive the cutting mechanism to rotate around the axis of its length extension direction, making the cutting part cut the soil along the plane of the axis perpendicular to the extension direction of the length.

According to the device of in-situ cutting soil in borehole of the present invention, the cutting part of the cutting mechanism can be extended outward until it is embedded in the borehole wall soil of the prefabricated borehole under the action of the telescopic driving mechanism and the rotating driving mechanism, and then rotates to cut the soil along a plane, so that the test surface of the subsequent borehole test can be a plane.

Preferably, the cutting mechanism also includes a connecting mechanism arranged along the length extension direction of the cutting mechanism and located between the driven driving part and the cutting part, the connecting mechanism includes a spline shaft fixedly connected to the driven part, the other end of the spline shaft can be movablely plugged into an axle sleeve, the other end of the axle sleeve is fixed to a cutterhead, a cutting tool for cutting soil is set on the cutterhead; wherein, when the spline shaft rotates under the drive of the rotating drive mechanism, the axle sleeve can rotate in linkage; when the telescopic drive mechanism drives the cutting mechanism to expand, the axle sleeve extends along the length extension direction relative to the spline shaft.

Preferably, a side of the base is provided with a borehole extending from the accommodation cavity to the outside of the base, and the borehole is used as the installation space of the rotating drive mechanism.

Preferably, an end of the spline shaft inserted into the axle sleeve is constructed as a triangular column, a square column, a ladder column, a prism or a geometric column, and the corresponding end of the axle sleeve is provided with a shape matching insert. And/or The structure between the cutterhead and the cutting tool is a detachable connection, wherein, an embedded slot for detachable connection is set on the cutterhead, and the cutting tool is embedded on the cutterhead through the embedded slot. And/or The cutting tool includes a connecting part connected to the cutterhead and a sharp part convexly arranged on the cutterhead, the longitudinal section structure of the sharp part is a triangle.

Preferably, the telescopic driving mechanism includes a guide plate of gear rack arranged to the top of the base, racks are installed on the guide plate of gear rack, the racks are meshed to a rotatable telescopic drive gear, the guide plate of gear rack can slide along the same expansion direction as the cutting mechanism under the drive of the expansion drive gear through the racks, the rack guide plate is connected to a connecting pin extending to the cutting mechanism, the other end of the connecting pin is connected to the axle sleeve drive mechanism sleeved on the axle sleeve, wherein, the axle sleeve drive mechanism is constructed to drive the axle sleeve to expand relative to the spline shaft but not rotate with the axle sleeve.

Preferably, the axle sleeve drive mechanism includes an axle sleeve fixed sleeve, the axle sleeve fixed sleeve is provided with a first convex ring extending inward along its radial direction on the inner surface of one side close to the driven part, the axle sleeve is provided with a second convex ring extending outward along its radial direction on the corresponding side; when the axle sleeve fixed sleeve is sleeved on the axle sleeve, the first convex ring is sleeved on the second convex ring; the axle fixed sleeve is embedded with an axle sleeve fixed ring connected to the sleeve on the inner surface outside the first convex ring, one end of the axle sleeve fixed ring is connected to the axial end surface of the first convex ring, the other end of the axle sleeve fixed ring is fixed by the first and second shield rings, the first shield ring is fixed to the axle sleeve fixed sleeve, the second shield ring is fixed to the sleeve; wherein, the inner surface of the axle sleeve fixed sleeve is provided with an annular first groove for fixing the first shield ring, the outer surface of the sleeve is provided with a second annular groove for fixing the second shield ring; a plug socket for connecting with the connecting pin is arranged on the axle sleeve fixed sleeve(through borehole and blind borehole can be). And/or The top of the base is provided with a gear shaft connecting the telescopic drive gear and a gear shaft seat for fixing the gear shaft, the gear shaft runs through the gear shaft seat, the telescopic drive gear is connected to the gear shaft located below the gear shaft seat. And/or The top of the base is provided with a long strip connecting pin perforation for the connecting pin to pass through and move, and the connecting pin perforation extends along the sliding direction of the guide plate of gear rack.

Preferably, a bottom surface of the gear shaft seat is attached to the guide plate of gear rack, the bottom of the gear shaft seat is provided with a gap extending to its circumference, the gap includes at least an area above the connecting pin, which avoids interference between the connecting pin and the gear shaft seat. And/or The top of the base is provided with a groove for accommodating and installing the gear shaft seat, a chute is arranged in the groove to slide the guide plate of gear rack, both ends of the chute extend to the outside of the base, when the guide plate of gear rack is arranged in the groove, its side away from the telescopic drive gear fits on the side of the groove, wherein, the guide plate of gear rack is provided with a long strip-shaped rack slot for installing the rack along its sliding direction.

Preferably, the device also includes a first motor for connecting the gear shaft and a second motor connected to the active drive part by a transmission.

Preferably, it further includes four groups of cutting mechanisms, the four groups of cutting mechanisms are extended or retracted at the same time with the same amount of expansion under the drive of the telescopic drive mechanism, and the four groups of cutting mechanisms rotate along the same rotation direction around the axis of the length extension direction under the drive of the rotating drive mechanism.

Preferably, it further includes four guide plates of gear rack, a first chute is arranged in the groove for sliding two guide plates of gear rack, both ends of the first chute extend to the outside of the base, a second chute is arranged in the groove for sliding the remaining two guide plates of gear rack, both ends of the second chute extend to the outside of the base, the bottom surface oft chute is higher than the bottom surface of the second chute and the first chute and the second chute are arranged alternately, it is preferred that the first chute and the second chute are perpendicular to each other, wherein the first chute or the two rack guide plates in the second chute are arranged side by side along the sliding direction of the guide plate of gear rack. And/or The guide plate of gear rack is constructed as a narrow part at one end and a wide part at the other end along its sliding direction, the wide part along the sliding direction perpendicular to the guide plate of gear rack is larger than that of the narrow part; wherein when the two guide plates of gear rack in the first chute or the second chute are arranged, the wide part of one guide plate of gear rack fits the narrow part of the other guide plate of gear rack, the narrow part fits the wide part of the other guide plate of gear rack, and the middle of the two guide plates of gear rack is surrounded by a passage, so that four racks can be meshed simultaneously through one of the telescopic drive gears arranged in the passage.

Preferably, a height of the device is 130-140 mm, and a width of the device is 140-150 mm. And/or An expansion amount of the cutting mechanism is 15-20 mm.

Preferably, the wide part is provided with a perforation for connecting the connecting pin(through borehole and blind borehole can be), the wide part is also provided with a step groove extending along the sliding direction of the guide plate of gear rack at the corner of the narrow part and close to the telescopic drive gear, which avoids the interference between the wide part and the rack.

Preferably, the structure of the base is a block column, and the length extension direction of the cutting mechanism is perpendicular to the axial direction of the base.

Preferably, the active drive part is constructed as an active bevel gear, the driven drive part is constructed as a driven bevel gear, and the telescopic drive gear is constructed as a spur gear.

In the second aspect, the present invention also provides a method for in-situ cutting soil in borehole, based on the device of in-situ cutting soil in borehole of the above technical scheme, the method includes the following steps:

putting the device into a prefabricated borehole until it reaches a predetermined position in the prefabricated borehole;

the first motor starts and rotates forward, and the four groups cutting mechanisms extend outward slowly at the same time with the same expansion amount until the outermost tool is embedded in the borehole wall soil of the prefabricated borehole, then the first motor stops working;

the second motor starts and works, the cutting tools of four groups cutting mechanism cut the soil along the plane with the same rotation direction and rotation speed until the cutting soil is completed, then the second motor stops working;

the first motor starts and reverses again until the four groups cutting mechanisms shrink back to the original position, then the first motor stops working, and finally the device is taken out from the prefabricated borehole.

According to the method of the present invention, the operation is simple, and the tool cuts the soil along the plane, which realizes that the test surface of the subsequent borehole test is a plane. In addition, it can cut the soil in four directions at the same time, and the efficiency is high.

By using the technical scheme according to the embodiment of the invention, the beneficial effect can be obtained at least:

1. the devices of the present invention, the cutting part of the cutting mechanism can be extended outward and embedded in the soil of the borehole wall of the prefabricated borehole under the action of the telescopic driving mechanism and the rotating driving mechanism, and then rotates to cut the soil along the plane, so that the test surface of the borehole test is a plane;
2. the device of the present invention can cut soil in four directions at the same time, and has high efficiency;
3. the device of the present invention is simple to operate when cutting soil.

The additional advantages, purpose, and features of the invention will be partially described in the following description, and it will become partially obvious to the general technical personnel in this field after studying the following, or may be known according to the practice of the invention. The purpose and other advantages of the invention can be realized and obtained by the structure specified in the specification and the attached figure.

The technical personnel in this field will understand that the purpose and advantages that can be achieved by the invention are not limited to the above specifics, and the above and other purposes that can be achieved by the invention will be more clearly understood according to the following detailed instructions.

BRIEF DESCRIPTION OF THE DRAWINGS

The drawings described are used to provide a further understanding of the invention and form part of the application, which does not constitute a limitation of the invention. The parts in the drawings are not drawn in proportion, but only to show the principle of the invention. In order to facilitate the presentation and description of some parts of the invention, the corresponding parts in the attached figure may be enlarged, that is, other parts in the example device may become larger than those actually manufactured according to the invention. In the drawings.

LABELS OF DRAWINGS

10. device

Figure 1:
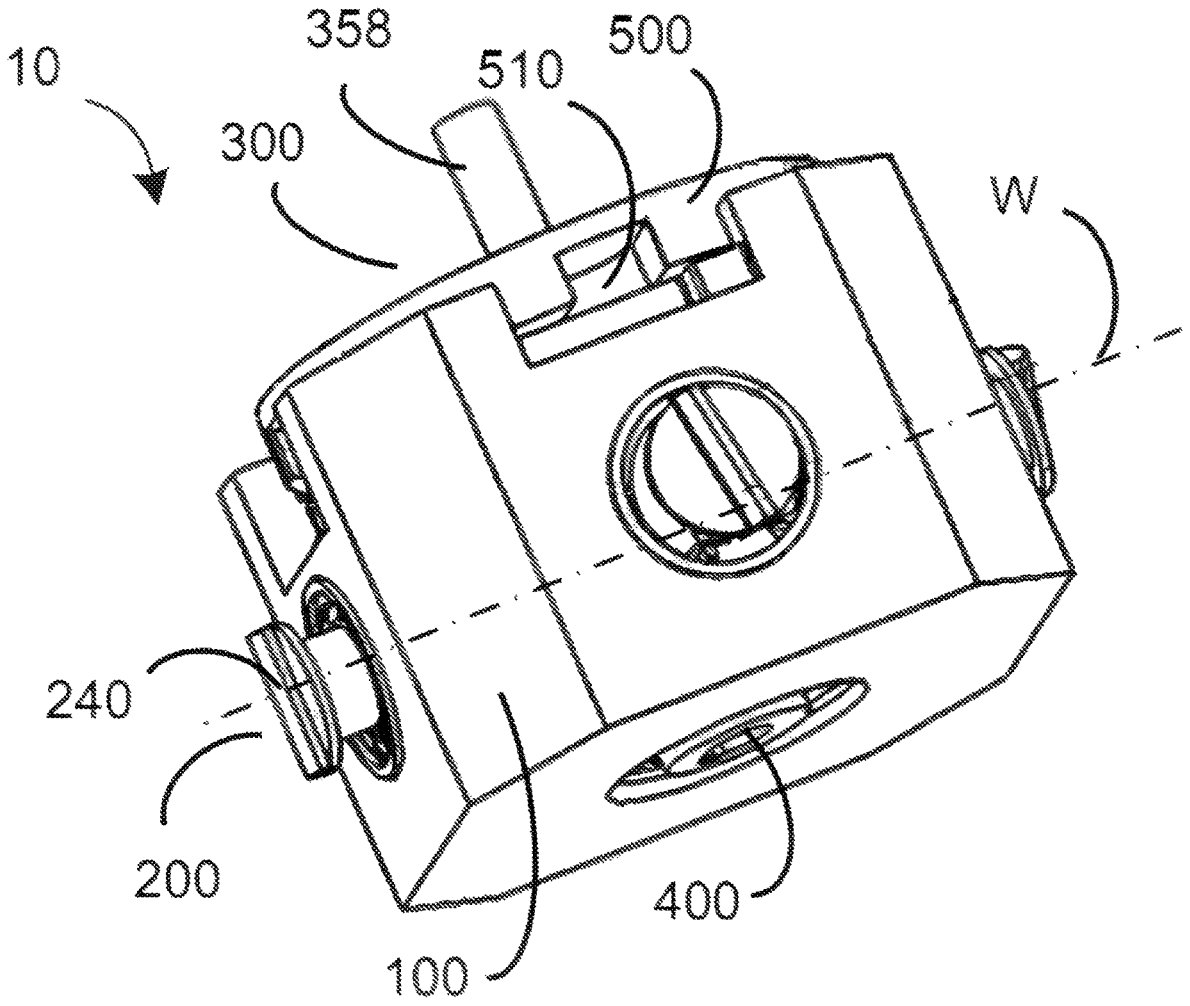
FIG. 1 is an overall schematic diagram of the device for in-situ cutting soil in borehole of an embodiment of the present invention.

100. base; 110. accommodation cavity; 120. borehole; 130. groove; 140. chute; 141. the first chute; 142. the second chute; 150. connecting pin perforation; 200. cutting mechanism; 210. driven bevel gear; 220. spline axle; 230. axle sleeve; 231. insert; 232. the second convex ring; 233. the second slot; 240. cutting part; 241. cutterhead; 242. embedded slot; 243. cutting tool; 244. connection; 245. sharp part; 300. telescopic drive mechanism; 310. guide plate of gear rack; 311. toothed bar slot; 312. narrow part; 313. wide part; 314. passage; 315. perforation; 316. step groove; 320. rack; 330. telescopic drive gear; 340. connecting pin; 350. shaft sleeve drive mechanism; 351. axle sleeve fixed sleeve; 352. the first convex ring; 353. shaft sleeve fixing ring; 354. the first shield ring; 355. the second shield ring; 356. the first slot; 357. plug socket; 358. gear shaft; 400. rotating drive mechanism; 410. driving bevel gear; 500. gear shaft; 510. gap; 520. mounting borehole;

W. the axis of the length extension direction;

L. sliding direction of rack guide plate.

DETAILED DESCRIPTION OF THE EMBODIMENTS

By reference to exemplary embodiments, the purposes and functions of the present invention and the methods used to achieve these purposes and functions will be clarified. However, the present invention is not limited to the following demonstrative embodiments as disclosed; it can be realized in different forms. The essence of the manual is only to help technicians in related fields to comprehensively understand the specific details of the invention.

It should be noted that the terminology used is only to describe the specific implementation method, not to limit the example implementation method according to the invention. As used in the invention, the singular form is also intended to include the plural form unless the context explicitly states otherwise. In addition, it should be understood that when the terms 'include' and/or 'comprise' are used in this instruction manual, it indicates the presence of features, wholes, steps, operations, components and/or assemblies, however, it does not exclude the existence or addition of one or more other features, wholes, steps, operations, components, assemblies and/or combinations thereof.

The ordinals such as 'first' and 'second' cited in this invention are only identifications and do not have any other meanings, such as a specific order. Moreover, for example, the term 'first part' itself does not imply the existence of 'second part', and the term 'second part' itself does not imply the existence of 'first part'.

It should be noted that the terms 'up', 'down', 'front', 'back', 'left', 'right', 'inside', 'outside' and similar expressions used in this paper are only for the purpose of explanation, not for restriction.

The present invention provides a device 10 and its application method for in-situ cutting soil in borehole. Wherein the device 10, for example, can be applied to the field of geotechnical engineering technology, for example, it is applied to in-situ (or on-site) borehole shear tests, as an in-situ test device in soil pores, it can be used to test soil strength parameters (at least part of the work).

Figure 2:
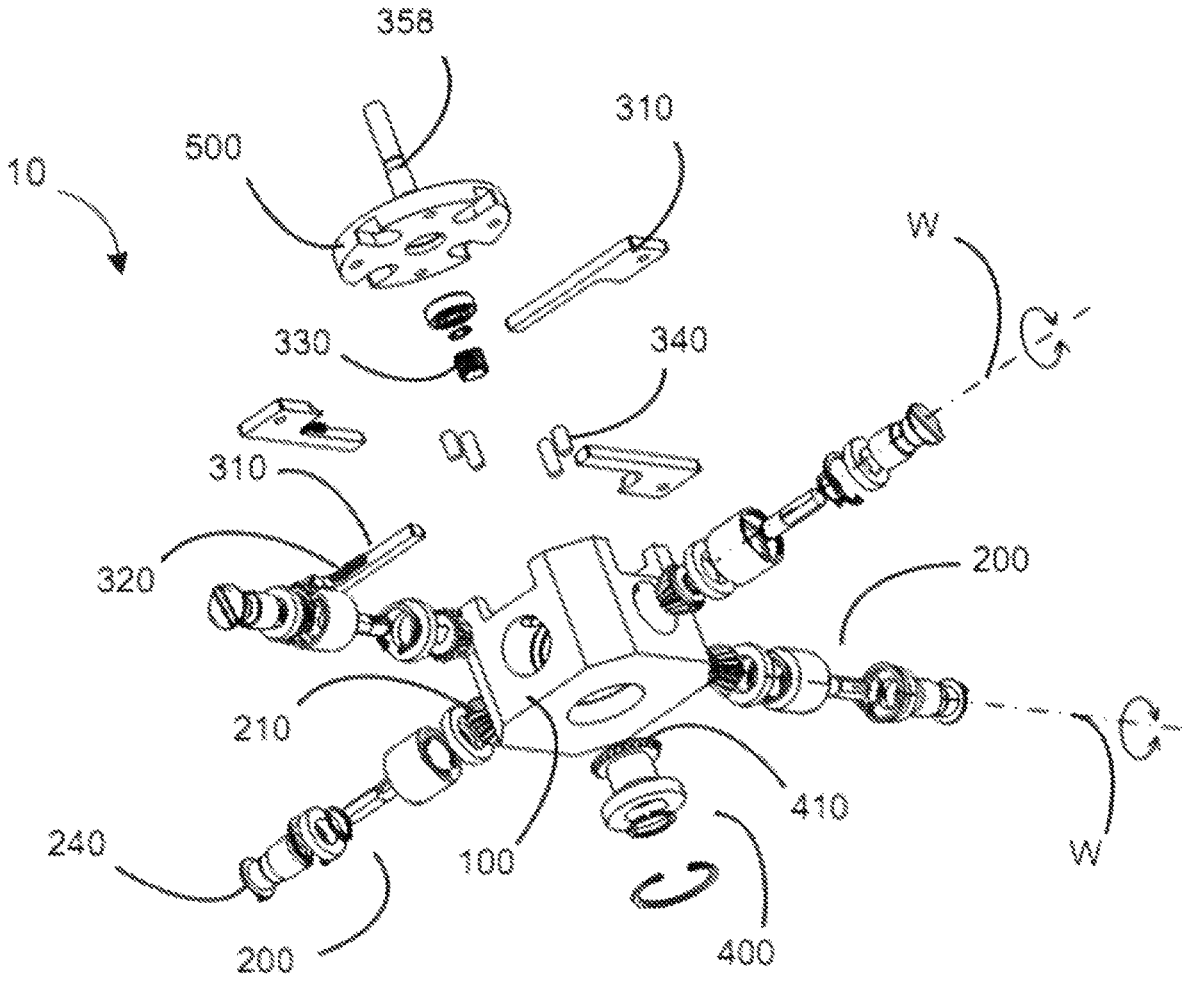
FIG. 2 is a decomposition diagram of the device for in-situ cutting soil in borehole of an embodiment of the present invention.

First aspect, the present invention provides a device 10 for in-situ cutting soil in borehole, in the preferred implementation, as shown in FIG. 1 and FIG. 2, wherein FIG. 1 is an overall schematic diagram of the device for in-situ cutting soil in borehole of an embodiment of the invention; FIG. 2 is a decomposition diagram of the device for in-situ cutting soil in borehole of an embodiment of the present invention. The device includes a base 100, a cutting mechanism 200, a telescopic drive mechanism 300 and a rotating drive mechanism 400. As an important part of the device, the cutting mechanism 200 can cut the soil along the plane. As another important part of the device, the telescopic driving mechanism 300 is used to drive the cutting mechanism 200 to stretch relative to the base 100. The rotating drive mechanism 400 is also another important part of the device, which is used to drive the cutting mechanism 200 to rotate, so that it can complete the cutting of the soil along the plane. Preferably, further, the overall height (i.e., the distance from the top of the gear shaft to the center of the base bottom) of the base 100 plus the gear shaft 358 is designed to be 130-140 mm (the following will be described in detail), for example, it can be 130 mm, 136 mm or 140 mm, its overall width is designed to be 140-150 mm, for example, it can be 140 mm, 145 mm or 150 mm. This makes the size of the device much smaller than the existing cutting device, which can effectively reduce the disturbance to the soil when cutting the soil (such as loess), and retain the in-situ nature of the soil during the test. In addition, the shape of the accommodation cavity 110 is not limited.

The cutting mechanism 200 is set to the base 100. The cutting mechanism 200 includes a driven driving part set to the accommodation cavity 110 and a cutting part 240 located at the opposite end of the driven driving part. Wherein, the driven driving part is a kind of structure that is driven by other driving parts (such as the active driving part to be described below) and passively transmitted accordingly, it can not limit the specific structure, in this embodiment, a driven bevel gear 210 (actually bevel gear) can be used, other structures that can achieve similar effects and effects also belong to this category and are not extended. In order to facilitate the explanation, the driven drive parts in the following are described by using the driven bevel gear 210 as an example. In the present invention, the cutting part 240 rotates through the driven driving part. Wherein the cutting part 240 is a cutting actuator that can cut the soil along the plane, and it can also not limit the specific structure. The invention will take the cutterhead 241 and the cutting tool 243 as an example for specific explanation (to be explained below), but it does not mean that it is limited.

The telescopic drive mechanism 300 is set to the top of the base 100 and connected to the cutting mechanism 200, the driveable cutting mechanism 200 stretches relative to the base 100 along its length extension direction. The telescopic drive mechanism 300 is a structure used to drive the cutting mechanism 200 to expand, which will be expanded in detail below.

The rotating drive mechanism 400 is set to the bottom of the base 100. The rotating drive mechanism 400 includes an active drive part set to the accommodation cavity 110, wherein the active driving part is a kind of structure that transmits to other driving parts (such as the driven driving part), it can not limit the specific structure, in this embodiment, the active bevel gear 410 (actually bevel gear) can be used. The active drive part can be itself with a driving force, or it can be itself without a driving force, and it needs to be connected to a driving mechanism (such as a motor), for example, connected to a second motor through a transmission (not shown). Wherein transmission parts are the conventional structures in this field, such as transmission shafts, etc. The bottom of the corresponding base 100 is provided with a borehole 120 for installing the rotating drive mechanism 400. The rotating drive mechanism 400 is driven by the active drive part and the driven drive part to drive the cutting mechanism 200 to rotate around the axis W of its length extension direction. The cutting part 240 cuts the soil along the plane of the axis perpendicular to the length extension direction. Similarly, in order to facilitate the explanation, the active drive part in the following will be described with the active bevel gear 410 as an example.

Continue to refer to FIG. 1 and FIG. 2, in the embodiment, the device includes four sets of cutting mechanism 200. The four groups of cutting mechanism 200 are extended or retracted at the same time with the same amount of expansion and contraction under the drive of the telescopic drive mechanism 300, and the four sets of cutting mechanism 200 rotate along the axis of the same rotation direction around the length extension direction under the drive of the rotating drive mechanism 400. This makes the device can cut the soil in four directions at the same time, and the efficiency is high.

It can be understood that FIG. 1 and FIG. 2 show a preferred implementation method, in the implementation mode not shown in the figures, the device can only set a set of cutting mechanism 200, it can also be set up two or three groups of cutting mechanism 200, even within a reasonable range of more groups of cutting mechanism 200 (such as six groups, eight groups).

According to the device of in-situ cutting soil in borehole of the present invention, the cutting part 240 of the cutting mechanism 200 is under the action of the telescopic drive mechanism 300 and the rotating drive mechanism 400, it can extend outward until embedded in the borehole wall soil of the prefabricated borehole, and then rotate along the plane to cut the soil, in this way, the test surface of the subsequent borehole test is a plane.

Figure 4:
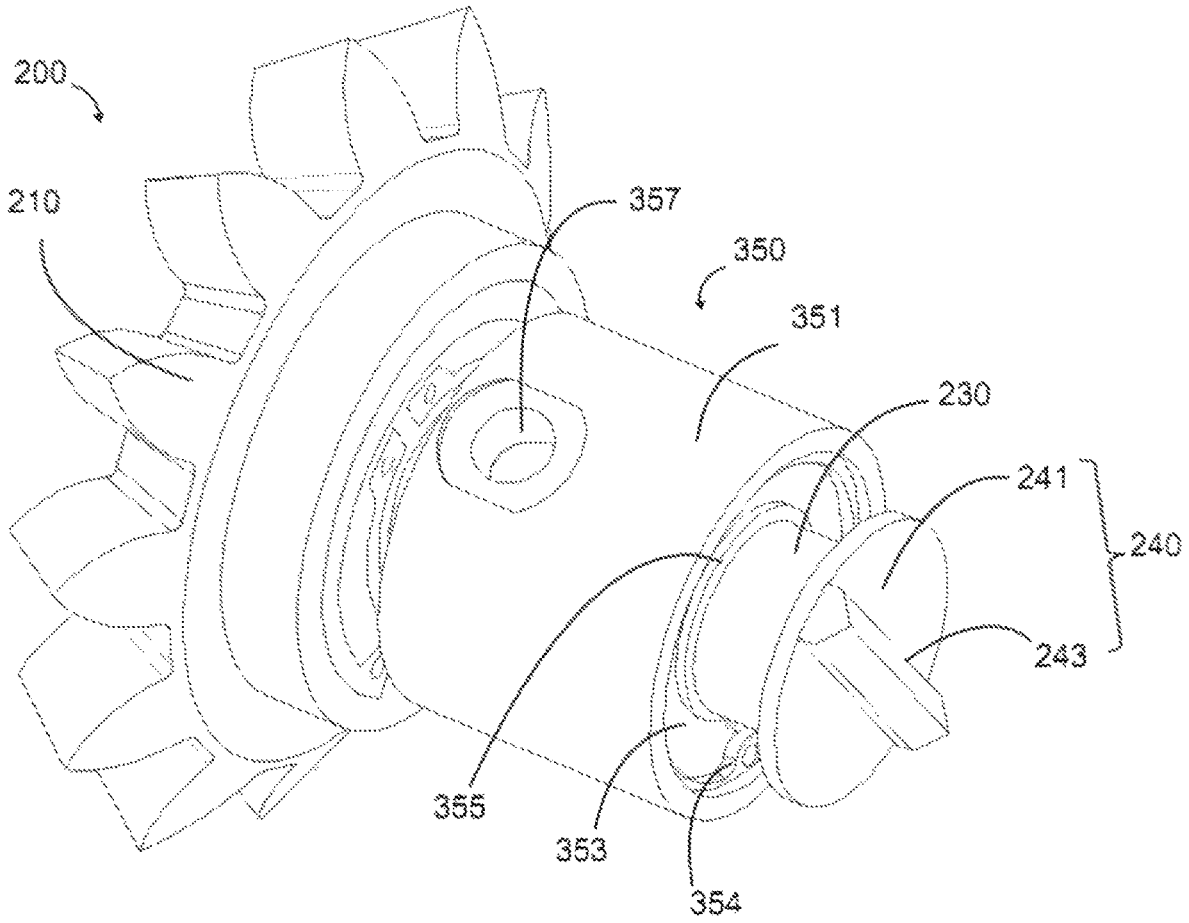
FIG. 4 is a schematic diagram of the cutting mechanism in the device of in-situ cutting soil in borehole of an embodiment of the present invention.
Figure 5:
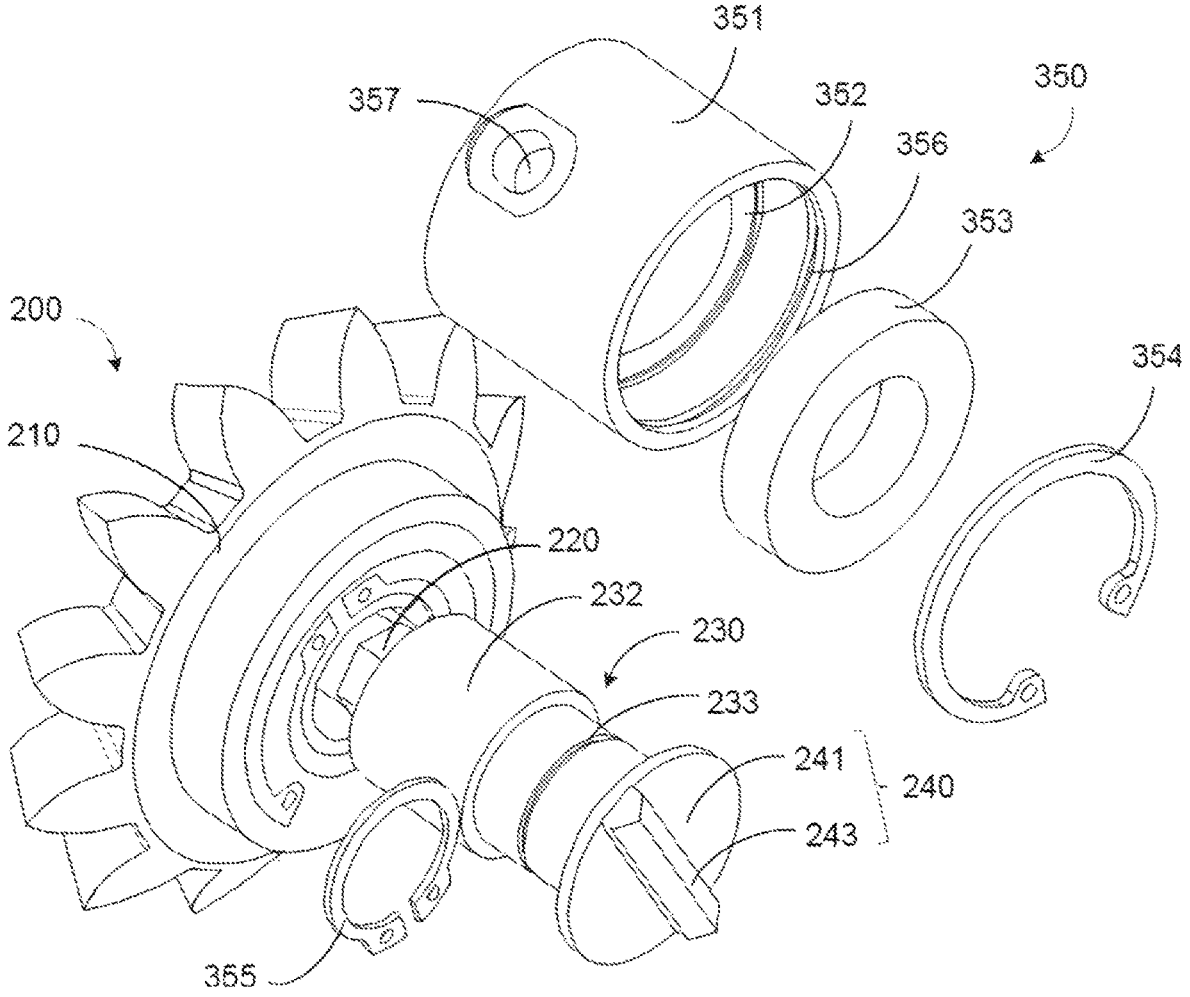
FIG. 5 is a decomposition diagram of the cutting mechanism shown in FIG. 4.
Figure 7:
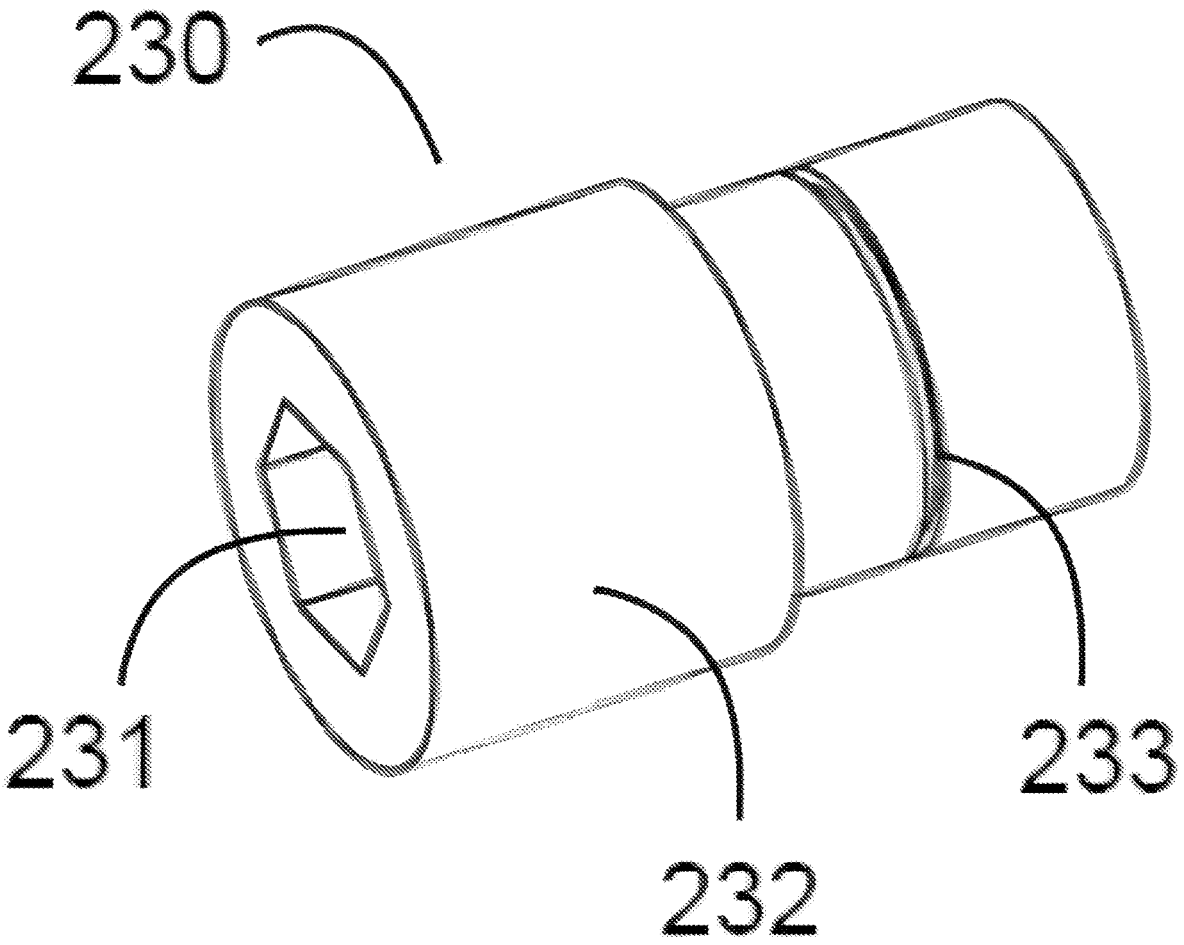
FIG. 7 is a schematic diagram of the sleeve in the device of in-situ cutting soil in borehole of an embodiment of the present invention.

Refer to FIG. 4 and FIG. 5, wherein FIG. 4 is a schematic diagram of the cutting mechanism 200 in the device for in-situ cutting soil in borehole of the embodiment of the present invention; FIG. 5 is a decomposition diagram of the cutting mechanism 200 shown in FIG. 4. In order to provide a specific and ingeniously designed cutting mechanism 200, the cutting mechanism 200 can also include a connecting mechanism arranged along the length extension direction of the cutting mechanism 200 and located between the driven bevel gear 210 and the cutting part 240. Preferably, the connecting mechanism can include a spline axle 220 fixed with the driven bevel gear 210. Wherein the other end of the spline axle 220 is movablely plugged into the axle sleeve 230. The other end of the sleeve 230 is fixed to the cutterhead 241. The cutting tool 243 for cutting soil is set on the cutterhead 241. Wherein when the spline axle 220 rotates under the drive of the rotating drive mechanism 400, the sleeve 230 can rotate in linkage(the cutterhead 241 and the cutting tool 243 are driven to rotate together, so that the cutting tool 243 performs cutting soil). When the telescopic drive mechanism 300 drives the cutting mechanism 200 to expand, the axle sleeve 230 stretches along the length extension direction relative to the spline axle 220, that is to say, when the telescopic drive mechanism 300 drives the cutting mechanism 200 to expand, in fact, the spline axle 220 is not retractable, only the sleeve 230 performs the expansion, that is to say, the axle sleeve 230 is movably socketed on the spline shaft 220, it can be along the spline axle 220 relative to the relative movement of the spline axle 220. In order to realize the spline axle 220 with axle sleeve 230 together can rotate, the end structure of the spline axle 220 inserted into the axle sleeve 230 is triangular column, square column, ladder column, prism and geometric column, it can also be other shapes that can achieve the above functions. The corresponding end of the axle sleeve 230 is provided with a shape matching insert 231, wherein the specific structure of the axle sleeve 230 can be referred to FIG. 7, which is a schematic diagram of the shaft sleeve in the device of in-situ cutting soil in borehole of the first embodiment of the invention.

Wherein, in order to install the cutting mechanism 200, and the cutting mechanism 200 can expand and contract relative to the base 100 within the base 100, the side of the base 100 is provided with the borehole 120 extending from the accommodation cavity 110 to the outside of the base 100. In order to better operate the device, the extension direction of the borehole 120 (i.e., the length extension direction of the cutting mechanism 200 or the expansion direction of the cutting mechanism 200) is perpendicular to the axial direction of the base 100. In this way, after the device 10 is placed in the prefabricated borehole along the axial direction of the prefabricated borehole, the subsequent work flow can be performed without adjusting the angle of the axial direction of the device. Similarly, in order to install the rotating drive mechanism (at least part of it is included), and the bottom surface of the base 100 is also provided with a borehole extending from the accommodation cavity 110 to the outside of the base 100.

Figure 6:
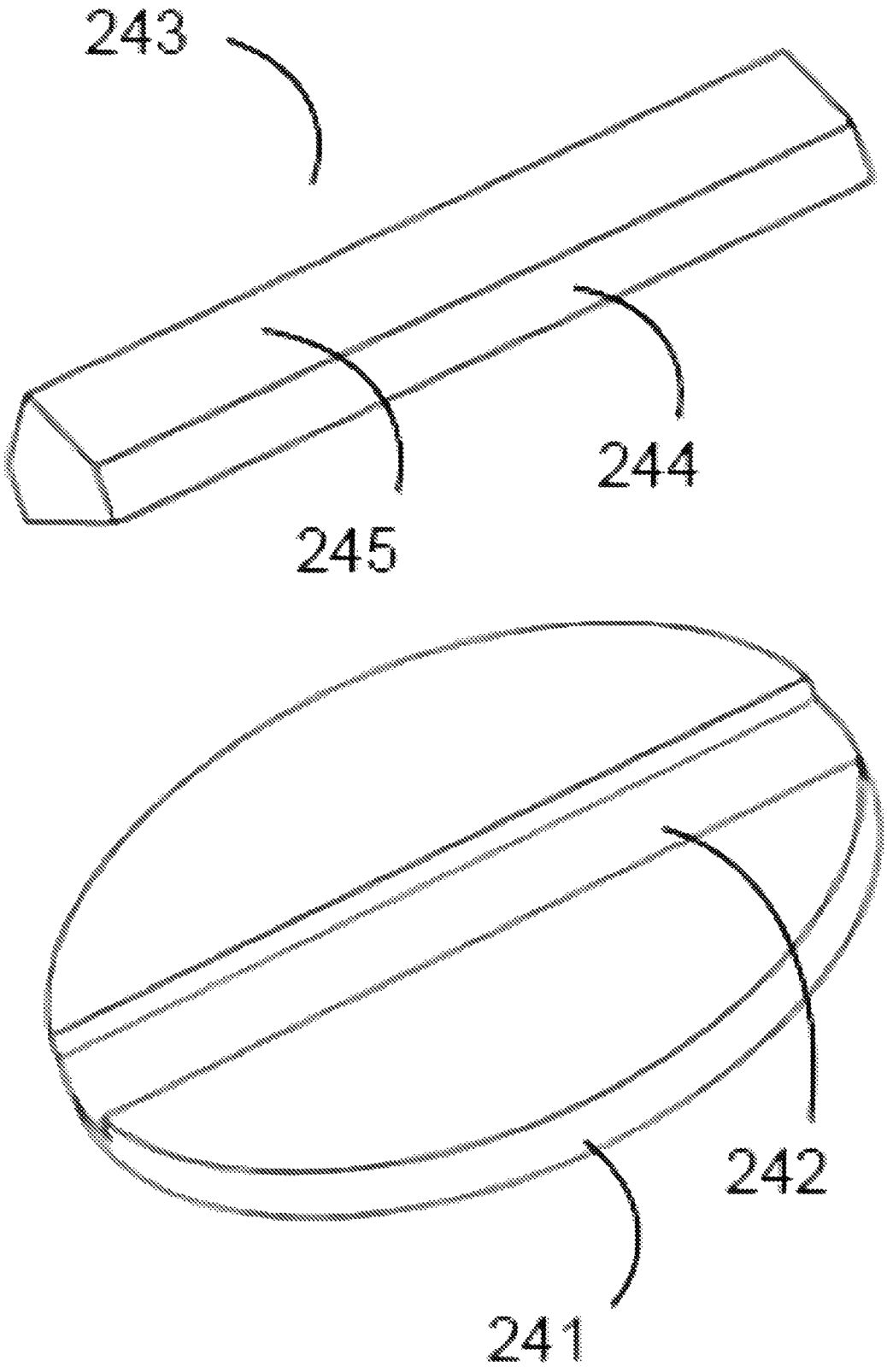
FIG. 6 is a decomposition diagram of the cutting part in the device of in-situ cutting soil in borehole of an embodiment of the present invention.

Further, in order to facilitate the cutting mechanism 200 cutting soil better, the cutting tool 243 includes a connection 244 connected to the cutterhead 241 and a sharp part 245 convexly arranged on the cutterhead 241. Preferably, the longitudinal section of the sharp part 245 is triangular, which is more conducive to the smooth cutting of the soil by the cutting tool 243. In addition, as shown in reference to FIG. 6, FIG. 6 is a schematic diagram of the decomposition of the cutting part of the device for in-situ cutting soil in borehole of the embodiment of the invention. In order to realize the convenient disassembly and assembly between cutterhead 241 and cutting tool 243, wherein the embedded slot 242 for detachable connection is set on the cutterhead 241. The cutting tool 243 is embedded in the cutterhead 241 through the embedded slot 242.

Figure 10:
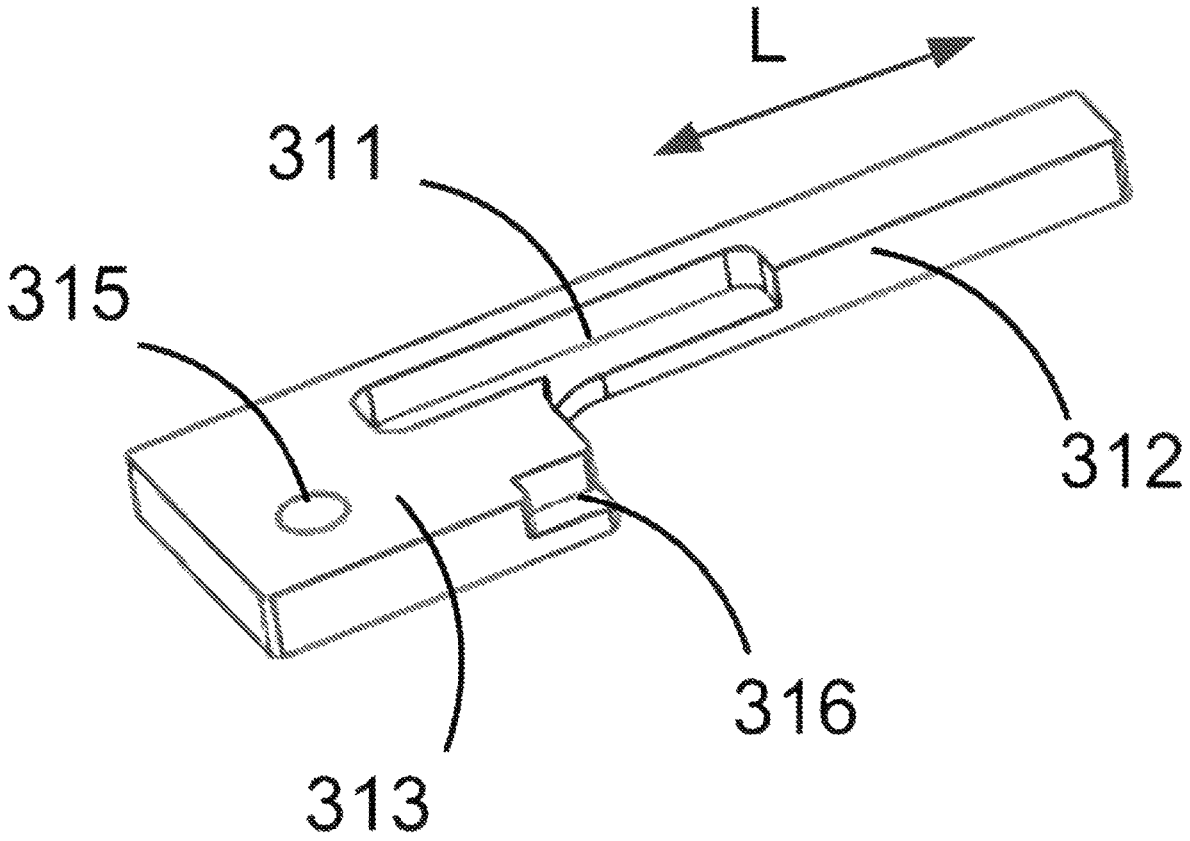
FIG. 10 is a schematic diagram of the rack guide plate in the device of in-situ cutting soil in borehole of an embodiment of the present invention.

Continue to refer to FIG. 2, FIG. 5 and FIG. 10, wherein FIG. 10 is a schematic diagram of the rack guide plate in the device of in-situ cutting soil in borehole of an embodiment of the invention. In order to provide a cleverly designed telescopic drive mechanism 300, the telescopic drive mechanism 300 can include a guide plate of gear rack 310 set to the top of the base 100. The rack 320 is installed on the guide plate of gear rack 310. The rack 320 is meshed to the rotatable telescopic drive gear 330. Wherein the telescopic drive gear 330 is a common gear device, which can be a straight gear or a helical gear. The guide plate of gear rack 310 can slide along the same expansion direction as the cutting mechanism 200 under the drive of the telescopic drive gear 330 through the rack 320. The guide plate of gear rack 310 is connected to the connecting pin 340 extending to the cutting mechanism 200. The other end of the connecting pin 340 is connected to the axle sleeve 230 driving mechanism sleeved on the axle sleeve 230. Wherein, the axle sleeve 230 driving mechanism is constructed to drive the axle sleeve 230 to expand relative to the spline axle 220 but not rotate with the axle sleeve 230. The telescopic drive mechanism 300 of this embodiment is through the guide plate of gear rack 310, through the connecting pin 340 and the axle sleeve 230 drive mechanism to drive the axle sleeve 230 (of course, including the cutterhead 241 and the cutting tool 243) for expansion.

Figure 8:
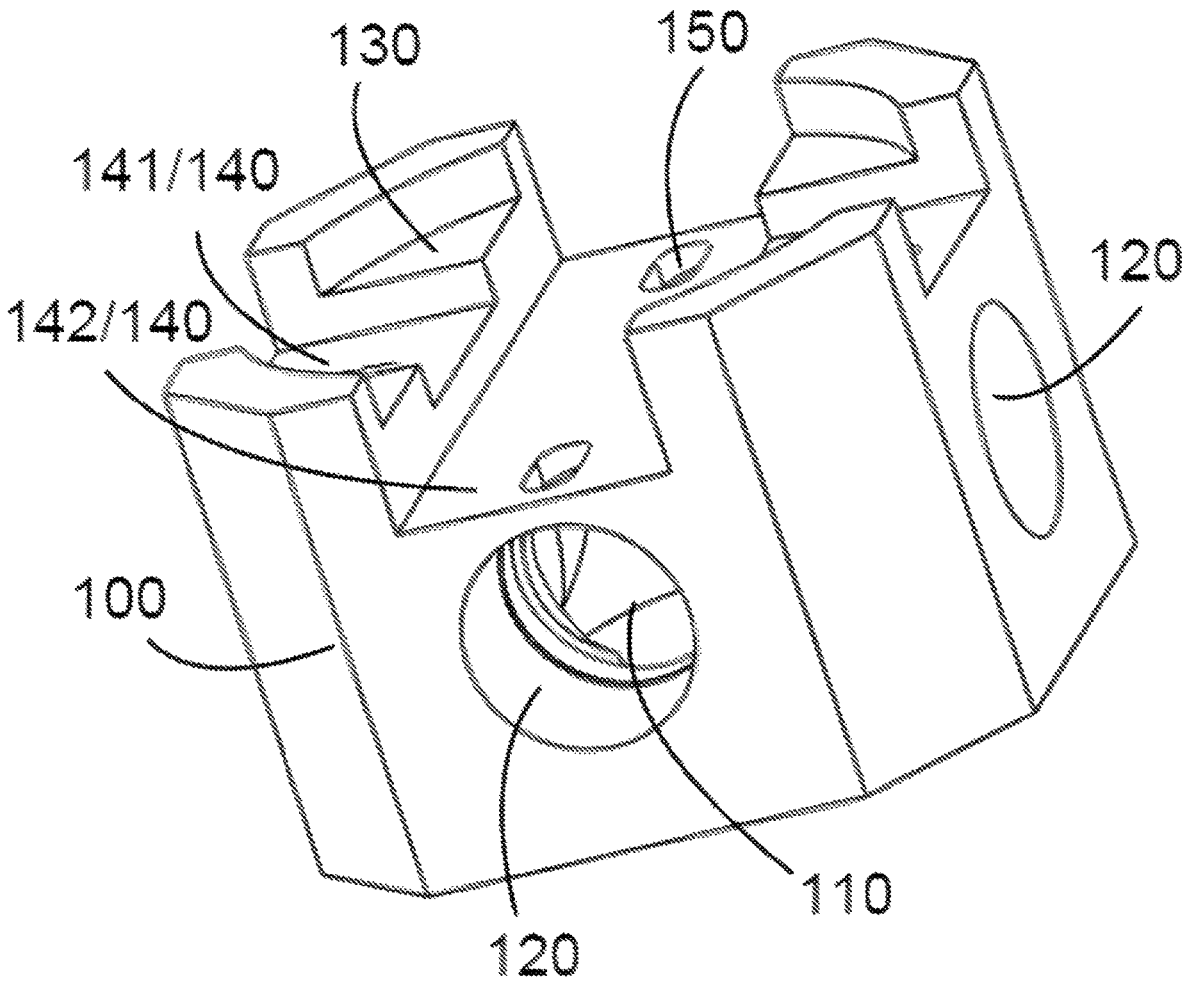
FIG. 8 is a schematic diagram of the base in the device of in-situ cutting soil in borehole of an embodiment of the present invention.

In order to achieve specific how to drive telescopic drive gear 330 rotation and installation, the top of the base 100 is equipped with a gear shaft 358 connected the telescopic drive gear 330 and a gear shaft seat for fixing the gear shaft 358. The gear shaft 358 runs through the gear shaft seat. The telescopic drive gear 330 is connected to the gear shaft 358 located below the gear shaft seat. Wherein the rotational power of the gear shaft 358 can, for example, be connected to the motor device, for example, be connect to the first motor (not shown). Referring to FIG. 8, wherein FIG. 8 is a schematic diagram of the base in the device of in-situ cutting soil in borehole of an embodiment of the invention. In order to better fix the gear shaft seat, the top of the base 100 is provided with a groove 130 for accommodating and installing the gear shaft seat. When the gear shaft seat is installed, it is fixed in the groove 130, and accordingly the gear shaft seat is also provided with a mounting borehole for connecting to the base 100. Preferably, in order to realize the sliding of guide plate of gear rack 310 on the base 100, the groove 130 is provided with a chute 140 for the sliding of the guide plate of gear rack 310. Both ends of the chute 140 can be extended to the outside of the base 100 in order to make the guide plate of gear rack 310 has a larger sliding space. When the guide plate of gear rack 310 is specifically arranged in the chute 140, its side away from the telescopic drive gear 330 is attached to the side of the chute 140 so that directional movement can be achieved. Wherein, the guide plate of gear rack 310 is provided with a long strip-shaped rack 320 slot 311 for installing the rack 320 along its sliding direction. The rack guide plate 310 is provided with a long strip-shaped toothed bar slot 311 for installing the rack 320 along its sliding direction. In order to make the guide plate of gear rack 310 slide more steadily, the bottom surface of the gear shaft seat can be attached to the rack guide plate of gear rack 310, the gear shaft seat can guide the guide plate of gear rack 310 from the top, the contact surface between the two is as smooth as possible to reduce the friction.

In the embodiment of the invention, the specific structure of the axle sleeve 230 driving mechanism may include an axle sleeve 230 fixed sleeve. The axle sleeve 230 fixed sleeve is equipped with a first convex ring 352 extending inward along its radial direction on the inner surface of one side near the driven bevel gear 210. The axle sleeve 230 is equipped with a second convex ring 232 extending outward along its radial direction on the corresponding side. When the axle sleeve 230 fixed sleeve is sleeved on the axle sleeve 230, the first convex ring 352 is sleeved on the second convex ring 232. The axle sleeve 230 fixed ring is embedded in the inner surface of the axle sleeve 230 fixed ring outside the first convex ring 352 (that is, the circumference of the axle sleeve 230 fixed ring is attached to the inner surface of the axle sleeve 230 fixing ring outside the first convex ring 352). One end of the axle sleeve 230 fixed ring is connected to the axial end surface of the first convex ring 352. The other end of the axle sleeve 230 fixed ring is fixed by a first shield ring 354 and a second shield ring 355. The first shield ring 354 is fixed to the axle sleeve 230 fixed sleeve. The second shield ring 355 is fixed to the axle sleeve 230. Wherein, the inner surface of the axle sleeve 230 fixed sleeve is provided with a ring-shaped first slot 356 for fixing the first shield ring 354. The outer surface of the axle sleeve 230 is provided with an annular second slot 233 for fixing the second shield ring 355. When the guide plate of gear rack 310 slides in the same expansion direction as the cutting mechanism 200, the axle sleeve 230 (including the cutterhead 241 and the cutting tool 243) will be moved synchronously through the connecting pin 340, the axle sleeve 230 fixed sleeve and the axle sleeve 230 fixed ring (in this paper, that is to say, relative to the base of 100 expansion and contraction). The sliding distance of the guide plate of gear rack 310 is equal to the expansion of the axle sleeve 230 (or the expansion of the cutting mechanism 200). In order to realize the movement of the connecting pin 340 within the base 100, the top of the base 100 is provided with a long strip connecting pin 340 perforation 315 for connecting pin 340 activity. The connecting pin 340 perforation 315 extends along the sliding direction of the rack 320 guide plate 310.

Since one of the major advantages of this device is that it has a compact structure and a small overall size, and it is suitable for some small-aperture prefabricated borehole scenarios, the expansion of the cutting mechanism 200 can be designed to be 15-20 mm, such as 15 mm, 18 mm or 20 mm.

Figure 9:
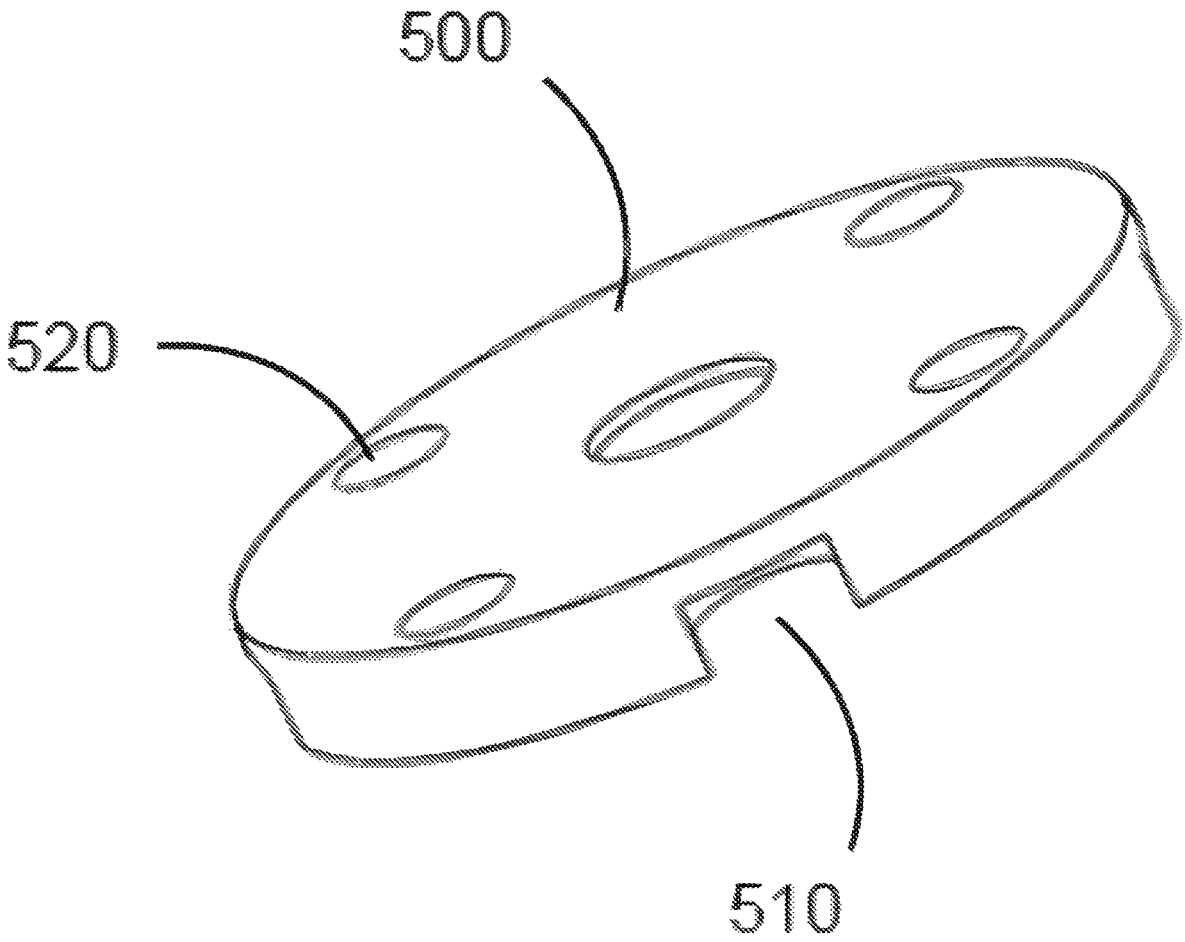
FIG. 9 is a schematic diagram of the gear shaft seat in the device of in-situ cutting soil in borehole of an embodiment of the present invention.

In addition, in order to realize the connection between the axle sleeve 230 fixed sleeve and the connecting pin 340, a plug socket 357 is set on the axle sleeve 230 fixed sleeve. The plug socket 357 can be a through borehole, that is, one end of the connecting pin 340 inserted into the through borehole can be connected to the ring surface of the second convex ring 232, or it can be a blind borehole. Similarly, in order to realize the connection between the guide plate of gear rack 310 and the connecting pin 340, the guide plate of gear rack 310 is provided with a perforated 315. The perforation 315 can be a through borehole or a blind borehole. The two ends of the connecting pin 340 can be fixedly connected with the axle shaft sleeve 230 fixed sleeve and the guide plate of gear rack 310, it can be either fixed connection or active connection (that is, it can be plugged in the corresponding borehole actively), and it can also be a fixed connection at one end and an active connection at the other end. In some cases, the end of the connection between the connecting pin 340 and the guide plate of gear rack 310 passes through the perforation 315 and there will still be a part of it protruding above the guide plate of gear rack 310, especially when the two ends of the connecting pin 340 are connected with the axle sleeve 230 fixed sleeve and the guide plate of gear rack 310, in this way, the connecting pin 340 of this part will interfere with the bottom surface of the gear shaft 358 seat(for example, the connecting pin 340 cannot move normally with the guide plate of gear rack 310, such as due to the large friction between the two). In order to solve this problem, as shown in FIG. 9, FIG. 9 is a schematic diagram of the gear shaft seat in the device of in-situ cutting soil in borehole of an embodiment of the invention. The bottom of the gear shaft 358 seat is provided with a gap 510 extending to its circumference. The gap 510 includes at least the area above the connecting pin 340 to avoid interference between the connecting pin 340 and the gear shaft 358 seat, meanwhile, it also has two other functions: on the one hand, the contact area between the guide plate of gear rack 310 and the gear shaft 358 seat is reduced, further reducing the friction between the guide plate of gear rack 310 when sliding; on the other hand, it can also be used as a heat dissipation borehole to dissipate the heat generated by the internal structure in a more timely manner.

In the preferred embodiment, in order to improve work efficiency, the device includes four groups of cutting mechanism 200. The four groups of cutting mechanism 200 are extended or retracted at the same time with the same expansion amount and under the drive of the telescopic drive mechanism 300, and the four groups of cutting mechanism 200 are driven by the rotating drive mechanism 400 to rotate along the same rotation direction around the axis W of the length extension direction. This makes the device can cut the soil in four directions at the same time, and the efficiency is high. In order to achieve the effect of compact structure, small size and better transmission, the device includes four guide plates of gear rack 310. In order to arrange the four guide plates of gear rack 310, the groove 130 is provided with the first chute 141 for the sliding of two guide plates of gear rack 310. The two ends of the first chute 141 can extend to the outside of the base 100. The second chute 142 is set in the groove 130 for the sliding of the remaining two guide plates of gear rack 310. Similarly, the two ends of the second chute 142 can also extend to the outside of the base 100. Wherein, the bottom surface of the first chute 141 is higher than that of the second chute 142, and the first chute 141 and the second chute 142 are cross-arranged. Wherein, the two guide plates of gear rack 310 in the first chute 141 and the second chute 142 are set side by side along the sliding direction of the guide plates of gear rack 310 respectively. At this time, when the guide plates of gear rack 310 are specifically arranged in the first chute 141 or the second chute 142, its side away from the telescopic drive gear 330 is attached to the side of the corresponding first chute 141 or the second chute 142. Preferably, the first chute 141 and the second chute 142 are perpendicular to each other, which makes the spacing between the four guide plates of gear rack 310 more reasonable and avoids mutual interference.

Figure 3:
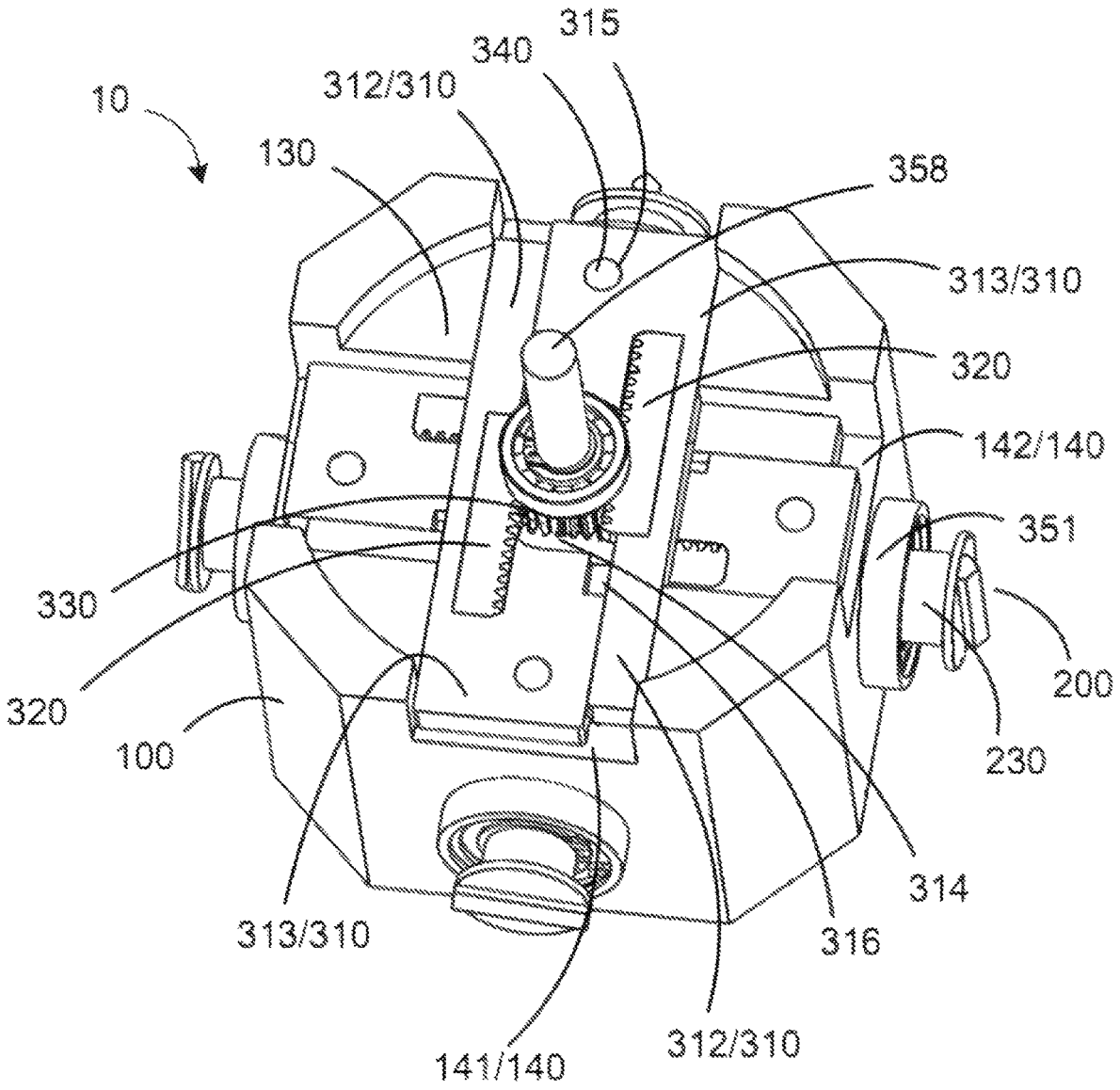
FIG. 3 is a top view of the device for in-situ cutting soil in borehole of an embodiment of the invention, at this time, the device hides the gear shaft seat.

Please refer to FIG. 10, according to the device of the invention, the guide plates of gear rack 310 are constructed along the sliding direction L of guide plates of gear rack 310, one end is a narrow part 312 and the other end is a wide part 313. The width part 313 along the sliding direction L perpendicular to the guide plates of gear rack 310 is larger than that of the narrow part 312. Wherein, referring to FIG. 3, when the two guide plates of gear rack 310 in the first chute 141 or the second chute 142 are arranged, wherein the wide part 313 of one guide plate of gear rack 310 fits the narrow part 312 of another guide plate of gear rack 310, its narrow part 312 fits the wide part 313 of another guide plate of gear rack 310, and the middle circumference of the two guide plates of gear rack 310 synthesizes a passage 314, the vertical telescopic drive gear 330 can be arranged in the passage 314, in this way, four racks 320 can be engaged simultaneously by the telescopic drive gear 330 arranged in the passage 314. The design is exquisite and the spatial layout is ingenious, it saves the trouble of arranging multiple telescopic drive gears 330, simplifies the structure, and further achieves the purpose of compact structure and small volume; meanwhile, the two guide plates of gear rack 310 in the first chute 141 or the second chute 142 are fitted on the side close to each other, and the two play a guiding role on the other side, making the guide plates of gear rack 310 smoother when sliding.

When the two guide plates of gear rack 310 in the first chute 141 or the second chute 142 are close to each other (that is, the cutting mechanism 200 is shrinking at this time), the wide part 313 (that is, the narrow part 312 of the other guide plate of gear rack 310) is set a step groove 316 extending along the sliding direction of the guide plate of gear rack 310 at the corner of the narrow part 312 and near the telescopic drive gear 330. Since the telescopic drive gear 330 arranged in the passage 314 must simultaneously engage the four racks 320 on the four guide plates of gear rack 310, this requires that at least part gear teeth of four racks 320 also extend into aisle 314, in this way, when the cutting mechanism 200 shrinks too much, it is possible that the wide part 313 and the rack 320 on the other guide plate of gear rack 310 may collide, which may damage the device. And through the above design of the step groove 316, when the cutting mechanism 200 shrinkage excessive case, the racks 320 on the other guide plate of gear rack (that is, the racks near the end of the wide part 313) may transition to the step groove 316, the problem of collision between the wide part 313 and the racks 320 on the other guide plate of gear rack 310 will not occur.

In summary, according to the device of the invention, the cutting part 240 of the cutting mechanism 200 can be extended outward and embedded in the borehole wall soil of the prefabricated borehole under the action of the telescopic driving mechanism 300 and the rotating driving mechanism 400, and then rotates to cut the soil along the plane, realizing that the test surface of the borehole test is a plane. Meanwhile, the device of the invention can set up four sets of cutting mechanism 200 to cut the soil in four directions at the same time, with high efficiency. In particular, the four guide plates of gear rack 310 in the four groups of cutting mechanism 200 is set side by side in pairs, in which the guide plate of gear rack 310 is set along the sliding direction L with one end of the narrow part 312 and the other end of the wide part 313, and the narrow part 312 and the wide part 313 are staggered and fitted with each other, and the design is ingenious. In addition, the device of the invention cuts the soil body, and the operation is simple.

Figure 11:
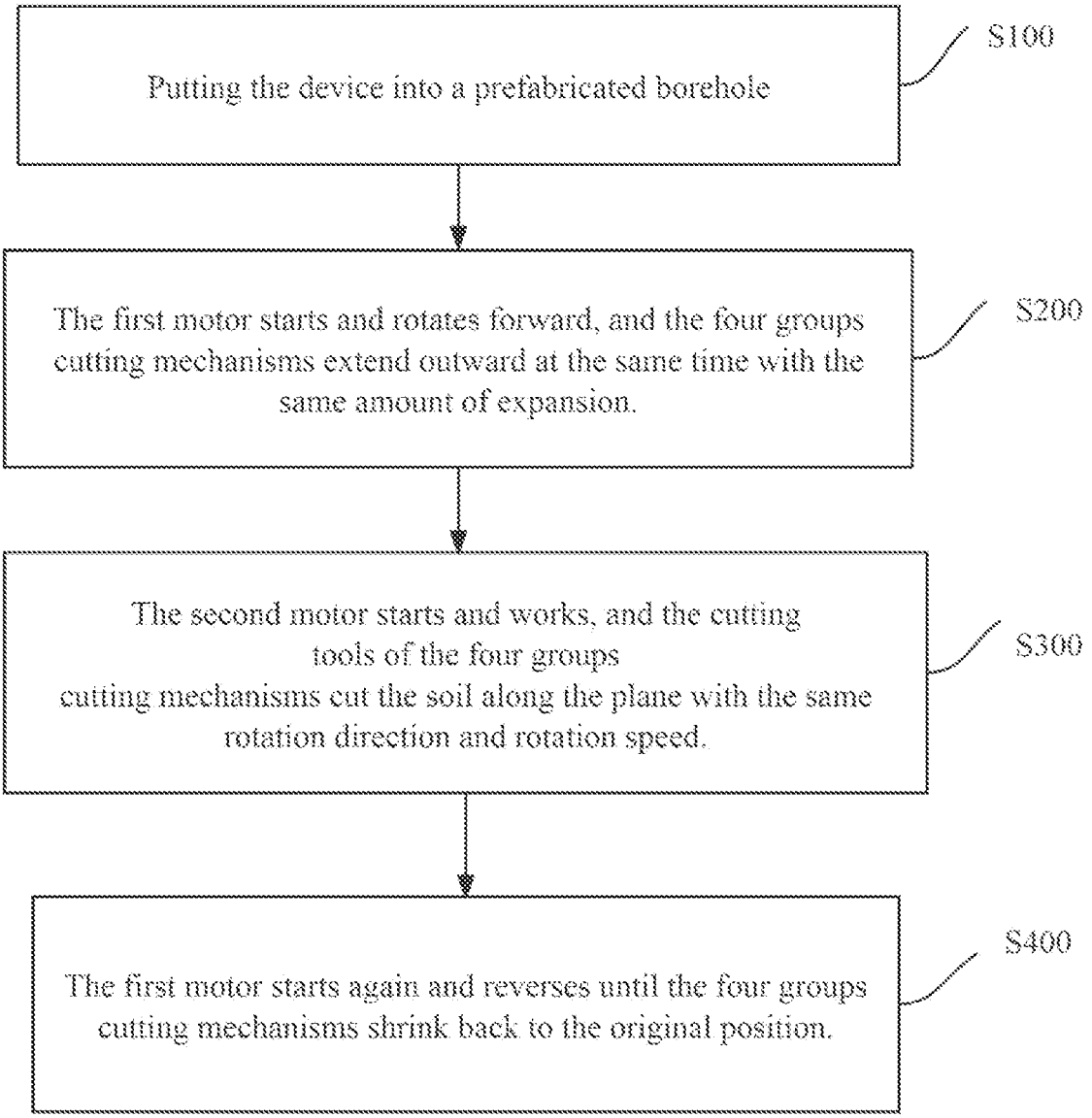
FIG. 11 is a flow chart of the use method of the device for in-situ cutting soil in borehole of an embodiment of the invention.

Secondly, the invention also provides a method for in-situ cutting soil in borehole according to the device for in-situ cutting soil in borehole of above embodiment, as shown in FIG. 11, the method includes the following steps:

S100. Putting the device into a prefabricated borehole until it reaches a predetermined position in the prefabricated borehole.

S200. The first motor starts and rotates forward, the four groups cutting mechanisms 200 extend outward slowly with the same expansion amount until the outermost cutting tool 243 is embedded in the borehole wall soil of the prefabricated borehole, then the first motor stops working.

S300. The second motor starts and works, the cutting tools 243 of four groups cutting mechanisms 200 cut the soil along the plane with the same rotation direction and rotation speed until the cutting soil is completed, then the second motor stops working.

S400. The first motor starts and reverses again until four groups cutting mechanisms 200 shrink back to the original position, then the first motor stops working, and finally the device is taken out from the prefabricated borehole.

According to the method of the invention, the operation is simple, and the cutting tool 243 cuts the soil along the plane, which realizes that the test surface of the subsequent borehole test is plane. In addition, it can cut the soil in four directions at the same time, and the efficiency is high.

In combination with the description and practice of the invention disclosed here, other embodiments of the invention are easy to think of and understand for technicians in this field. Illustrations and embodiments are only considered to be exemplary, and the true scope and purpose of the invention are limited by the claims.

What is claimed is:

1. A device for in-situ cutting soil in borehole, comprising:

a base in which an accommodation cavity is arranged;

a cutting mechanism, wherein the cutting mechanism is set to the base, the cutting mechanism comprises a driven driving part arranged in the accommodation cavity and a cutting part located at an opposite end of the driven driving part;

a telescopic drive mechanism, wherein the telescopic driving mechanism is arranged to a top of the base and connected to the cutting mechanism to drive the cutting mechanism to stretch relative to the base along a length extension direction; and a rotating drive mechanism, wherein the rotating drive mechanism is set to a bottom of the base, the rotating drive mechanism comprises an active driving part arranged in the accommodation cavity, the rotating drive mechanism is driven by the active driving part and the driven driving part to drive the cutting mechanism to rotate around an axis of the length extension direction, making the cutting part cut the soil along a plane of the axis perpendicular to the length extension direction;

wherein the cutting mechanism also comprises a connecting mechanism arranged along the length extension direction of the cutting mechanism and located between the driven driving part and the cutting part, the connecting mechanism comprises a spline shaft fixedly connected to the driven driving part, an other end of the spline shaft is movablely plugged into an axle sleeve, an other end of the axle sleeve is fixed to a cutterhead, and a cutting tool for cutting soil is set on the cutterhead;

wherein, when the spline shaft rotates under a drive of the rotating drive mechanism, the axle sleeve rotates in linkage; when the telescopic drive mechanism drives the cutting mechanism to expand, the axle sleeve extends along the length extension direction relative to the spline shaft.

2. The device for in-situ cutting soil in borehole according to claim 1, wherein the other end of the spline shaft inserted into the axle sleeve is constructed as a triangular column, a square column, a ladder column, a prism or a geometric column, and a corresponding end of the axle sleeve is provided with a shape matching insert; and/or a structure between the cutterhead and the cutting tool is a detachable connection, wherein, an embedded slot for detachable connection is set on the cutterhead, and the cutting tool is embedded on the cutterhead through the embedded slot; and the cutting tool comprises a connecting part connected to the cutterhead and a sharp part convexly arranged on the cutterhead, and a longitudinal section structure of the sharp part is a triangle.

3. The device for in-situ cutting soil in borehole according to claim 2, wherein the telescopic drive mechanism comprises a guide plate of gear rack arranged to the top of the base, racks are installed on the guide plate of gear rack, the racks are meshed to a rotatable telescopic drive gear, the guide plate of gear rack slides along a same expansion direction as the cutting mechanism under a drive of the telescopic drive gear through the racks, the guide plate of gear rack is connected to a connecting pin extending to the cutting mechanism, an other end of the connecting pin is connected to an axle sleeve drive mechanism sleeved on the axle sleeve, wherein, the axle sleeve drive mechanism is constructed to drive the axle sleeve to expand relative to the spline shaft but not rotate with the axle sleeve.

4. The device for in-situ cutting soil in borehole according to claim 3, wherein the axle sleeve drive mechanism comprises an axle sleeve fixed sleeve, the axle sleeve fixed sleeve is provided with a first convex ring extending inward along a radial direction on an inner surface of one side close to the driven driving part, the axle sleeve is provided with a second convex ring extending outward along its radial direction on a corresponding side; when the axle sleeve fixed sleeve is sleeved on the axle sleeve, the first convex ring is sleeved on the second convex ring; the axle sleeve fixed sleeve is embedded with an axle sleeve fixed ring connected to the axle sleeve on an inner surface outside the first convex ring, one end of the axle sleeve fixed ring is connected to an axial end surface of the first convex ring, an other end of the axle sleeve fixed ring is fixed by first and second shield rings, the first shield ring is fixed to the axle sleeve fixed sleeve, the second shield ring is fixed to the axle sleeve; wherein, an inner surface of the axle sleeve fixed sleeve is provided with an annular first groove for fixing the first shield ring, an outer surface of the axle sleeve is provided with a second annular groove for fixing the second shield ring; a plug socket for connecting with the connecting pin is arranged on the axle sleeve fixed sleeve; and the top of the base is provided with a gear shaft connecting the telescopic drive gear and a gear shaft seat for fixing the gear shaft, the gear shaft runs through the gear shaft seat, the telescopic drive gear is connected to the gear shaft located below the gear shaft seat, and the top of the base is provided with a long strip connecting pin perforation for the connecting pin to pass through and move, and the long strip connecting pin perforation extends along a sliding direction of the guide plate of gear rack.

5. The device for in-situ cutting soil in borehole according to claim 4, wherein a bottom surface of the gear shaft seat is attached to the guide plate of gear rack, a bottom of the gear shaft seat is provided with a gap extending to its circumference, the gap comprises at least an area above the connecting pin, which avoids an interference between the connecting pin and the gear shaft seat, and the top of the base is provided with a groove for accommodating and installing the gear shaft seat, a chute is arranged in the groove to slide the guide plate of gear rack, both ends of the chute extend to an outside of the base, when the guide plate of gear rack is arranged in the groove, its side away from the telescopic drive gear fits on a side of the groove, wherein, the guide plate of gear rack is provided with a long strip-shaped rack slot for installing the racks along its sliding direction.

6. The device for in-situ cutting soil in borehole according to claim 5, wherein the device further comprises four groups of cutting mechanisms, the four groups of cutting mechanisms are extended or retracted at a same time with a same amount of expansion under a drive of the telescopic drive mechanism, and the four groups of cutting mechanisms rotate along a same rotation direction around the axis of the length extension direction under a drive of the rotating drive mechanism.

7. A method for in-situ cutting soil in borehole, based on the device for in-situ cutting soil in borehole according to claim 6, comprising following steps:

putting the device into a prefabricated borehole until the device reaches a predetermined position in the prefabricated borehole;

starting a first motor to rotate forward, to drive the four groups of cutting mechanisms extend outward slowly at the same time with the same amount of expansion until an outermost cutting tool is embedded in a borehole wall soil of the prefabricated borehole, and stopping working of the first motor;

starting a second motor to works, to drive cutting tools of the four groups of cutting mechanisms to cut the soil along the plane with the same rotation direction and a same rotation speed until cutting of the soil is completed, and stopping working of the second motor; and starting the first motor to rotate reverse until the four groups of cutting mechanisms shrink back to an original position, stopping working of the first motor, and finally taking out the device from the prefabricated borehole.

8. The device for in-situ cutting soil in borehole according to claim 6, wherein the device further comprises four guide plates of gear rack, a first chute is arranged in the groove for sliding two guide plates of gear rack of the four guide plates of gear rack, both ends of the first chute extend to the outside of the base, a second chute is arranged in the groove for sliding remaining two guide plates of gear rack of the four guide plates of gear rack, both ends of the second chute extend to the outside of the base, a bottom surface of the first chute is higher than a bottom surface of the second chute and the first chute and the second chute are arranged alternately, it is preferred that the first chute and the second chute are perpendicular to each other, wherein the two guide plates of gear rack in the first chute or the remaining two guide plates of gear rack in the second chute are arranged side by side along the sliding direction of the guide plate of gear rack, and the guide plate of gear rack is constructed as a narrow part at one end and a wide part at an other end along its sliding direction, the wide part along a sliding direction perpendicular to the guide plate of gear rack is larger than the narrow part; wherein when the first chute or the remaining two guide plates of gear rack in the second chute are arranged, the wide part of one guide plate of gear rack fits the narrow part of an other guide plate of gear rack, the narrow part fits the wide part of the other guide plate of gear rack, and a middle of the two guide plates of gear rack is surrounded by a passage, so that four racks are meshed simultaneously through one of the telescopic drive gears arranged in the passage.

9. The device for in-situ cutting soil in borehole according to claim 8, wherein a height of the device is 130-140 mm, and a width of the device is 140-150 mm, and an expansion amount of the cutting mechanism is 15-20 mm, wherein the wide part is provided with a perforation for connecting the connecting pin, the wide part is also provided with a step groove extending along the sliding direction of the guide plate of gear rack at a corner of the narrow part and close to the telescopic drive gear, which avoids an interference between the wide part and the racks.

10. A method for in-situ cutting soil in borehole, based on the device for in-situ cutting soil in borehole according to claim 9, comprising following steps:

putting the device into a prefabricated borehole until the device reaches a predetermined position in the prefabricated borehole;

starting a first motor to rotate forward, to drive the four groups of cutting mechanisms extend outward slowly at the same time with the same amount of expansion until an outermost cutting tool is embedded in a borehole wall soil of the prefabricated borehole, and stopping working of the first motor;

starting a second motor to works, to drive cutting tools of the four groups of cutting mechanisms to cut the soil along the plane with the same rotation direction and a same rotation speed until cutting of the soil is completed, and stopping working of the second motor; and starting the first motor to rotate reverse until the four groups of cutting mechanisms shrink back to an original position, stopping working of the first motor, and finally taking out the device from the prefabricated borehole.

11. A method for in-situ cutting soil in borehole, based on the device for in-situ cutting soil in borehole according to claim 8, comprising following steps:

putting the device into a prefabricated borehole until the device reaches a predetermined position in the prefabricated borehole;

starting a first motor to rotate forward, to drive the four groups of cutting mechanisms extend outward slowly at the same time with the same amount of expansion until an outermost cutting tool is embedded in a borehole wall soil of the prefabricated borehole, and stopping working of the first motor;

starting a second motor to works, to drive cutting tools of the four groups of cutting mechanisms to cut the soil along the plane with the same rotation direction and a same rotation speed until cutting of the soil is completed, and stopping working of the second motor; and starting the first motor to rotate reverse until the four groups of cutting mechanisms shrink back to an original position, stopping working of the first motor, and finally taking out the device from the prefabricated borehole.

* * * * *